United States Patent [19]

Gray

[11] Patent Number: 4,769,089

[45] Date of Patent: Sep. 6, 1988

[54] METHOD OF ANNEALING AN APERTURE SHADOW MASK FOR A COLOR CATHODE RAY TUBE

[75] Inventor: Thomas H. Gray, Pittsburgh, Pa.

[73] Assignee: Allegheny Ludlum Corporation, Pittsburgh, Pa.

[21] Appl. No.: 89,639

[22] Filed: Aug. 25, 1987

[51] Int. Cl.[4] ..... C21G 9/00

[52] U.S. Cl. ..... 148/12 C; 148/6.35; 148/12.1; 156/644

[58] Field of Search ..... 148/6.35, 12 C, 12.1; 156/644

[56] References Cited

U.S. PATENT DOCUMENTS

| | | | |
|---|---|---|---|
| 2,806,162 | 9/1957 | McQuillen et al. | 313/64 |
| 4,210,843 | 7/1980 | Avadani | 313/403 |
| 4,325,752 | 4/1982 | Suda et al. | 148/12.1 |
| 4,427,396 | 1/1984 | van den Berg | 445/47 |
| 4,427,460 | 1/1984 | Araki et al. | 148/12 C |
| 4,528,246 | 7/1985 | Higashinakagawa et al. | 428/596 |
| 4,536,226 | 8/1985 | Ohtake et al. | 148/12 |
| 4,609,401 | 9/1986 | Simm et al. | 75/252 |
| 4,609,412 | 9/1986 | Kamio et al. | 148/12 C |

*Primary Examiner*—Upendra Roy
*Attorney, Agent, or Firm*—Patrick J. Viccaro

[57] ABSTRACT

An aperture mask comprised of a nickel-iron alloy having a low thermal expansion for a color CRT is produced by combining a first annealing to produce a low coercive force and mechanical properties desirable for a warm forming operation during which a desired profile of the mask is produced with minimized springback and a second annealing after forming to provide a stress free low coercive force mask also having an oxidized high thermal emissivity surface. Wherein the process requires control of the atmospheres and oxidizing potentials in the two annealing steps.

9 Claims, 1 Drawing Sheet

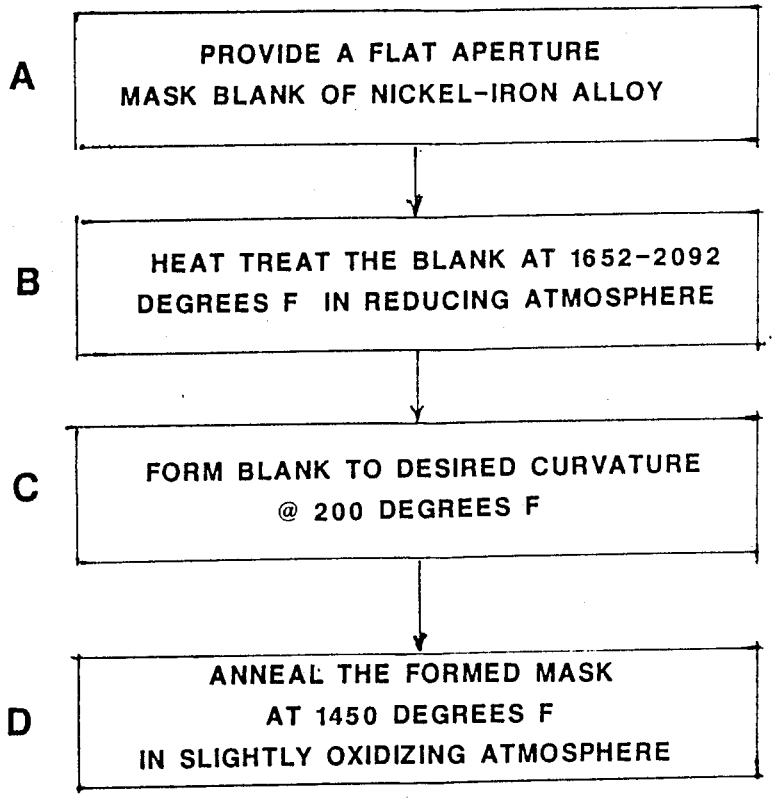
A
PROVIDE A FLAT APERTURE MASK BLANK OF NICKEL-IRON ALLOY
B
HEAT TREAT THE BLANK AT 1652-2092 DEGREES F IN REDUCING ATMOSPHERE
C
FORM BLANK TO DESIRED CURVATURE @ 200 DEGREES F
D
ANNEAL THE FORMED MASK AT 1450 DEGREES F IN SLIGHTLY OXIDIZING ATMOSPHERE

METHOD OF ANNEALING AN APERTURE SHADOW MASK FOR A COLOR CATHODE RAY TUBE

BACKGROUND OF THE INVENTION

1. Field of the Invention

This invention relates to a method of manufacturing an aperture mask for a color cathode ray tube and more particularly to a method of producing an aperture mask comprised of an iron-nickel alloy and as incident to forming the blank with a desired final contour an annealing process is carried out to produce a tightly adhered black oxide coating on the surface of the metal while at the same time relieving forming stresses and restoring to a low value the coercive force properties of the alloy metal.

2. Description of the Prior Art

U.S. Pat. Nos. 4,210,843; 4,427,396; 4,609,412; and 4,536,226 disclose various processed for the manufacture of aperture masks for a color cathode ray picture tube. In the manufacture of an apertured mask for a color cathode ray tube, one material commonly selected for the aperture mask is a low carbon steel. Typically a 1008 grade of aluminum killed or rimmed carbon steel is used as the mask material. Recent requirement for higher image quality have brought about the desire to utilize the iron-nickel alloy, such as Invar, because of a low thermal expansion characteristic of this material which reduces the effect commonly known in the industry as doming. Doming is a deflection of the aperture mask in a direction toward the phosphor screen due to a thermal input produced by electrom beams impinging on the mask material. Thermal compensating clips are usually provided to adjust the spacing between the mask and the phosphor screen according to the thermal input, however, adequate to compensate for non-uniform heating of the mask material as, for example, when a limited area of the mask receive a greater thermal input than other areas of the mask. For example, such a limited area can be a white area on the screen displaying an image representing the playing surface of a hockey game. As is well known, a white area displayed by a color CRT tube is produced by an excitation of all three color phosphor deposits by impingement of all three electron beams through an aperture opening in the mask. When this occurs all three electron beams also impinge on the mask material immediately adjacent to the aperture opening.

U.S. Pat. Nos. 2,806,162 and 4,528,246 both disclose benefits gained through the use of an Invar type nickel-iron alloy material in the manufacture of an aperture mask for an color CRT. In U.S. Pat. No. 4,536,226 there is disclosed a method of manufacturing a shadow mask wherein a sheet of nickel-iron alloy such as Invar is treated by perforating a number of apertures after which the apertured sheet is annealed at a temperature of between 1652 degrees F. and 2192 degrees F. for a period of ten minutes in vacuum. The annealed sheet is pressed to form a shadow mask while the sheet is kept at a forming temperature of about 360 degrees F. The elevated temperature of the shadow mask during the forming operation is effective to reduce the yield strength of the alloy material.

It has been discovered that by using the high temperature anneal and the warm forming of the shadow mask, it is possible to at least theoretically reduce or eliminate spring back when the mask blank is formed into an aperture mask.

SUMMARY OF THE INVENTION

The prevent invention seeks to provide an aperture mask for a color television CRT tube by providing a method for producing the apertured mask comprised of an iron-nickel alloy material known as Invar by utilizing a low thermal expansion characteristic of this material to limit localized doming of an aperture mask made thereform. It is a second characteristic of an aperture mask embodying the present invention to produce a mask material which has a D.C. magnetic coercive force of lower than 1.0 Oersted as measured from 10 kilogauss (kG) to render the CRT tube insensitive to deviations of flux in the Earth's magnetic field and to stray magnetic fields generated in the normal environment during operation of the display tube or color television. A third characteristic of an aperture mask embodying the current invention to produce a blackened surface on the mask material to an extent sufficient to at least provide high thermal emissivity to thereby lower the potential for doming as well as improve the functioning of the article as a shadow mask in conjunction with returning the material to the state of low coercive force. The present invention provides a solution for a requirement for an aperture mask namely that, through proper heat treatment, the mask blanks can be easily formed into aperture masks while providing a low mechanical spring back characteristic, and have the advantageous low D.C. coercive force.

It is an object of the present invention to provide a method for manufacturing apertured masks for color CRT tubes by achieving attributes of the mask of low thermal expansion, low mechanical spring back, low D.C. coercive force, and high thermal emissivity.

It is further object of the present invention to provide a process for manufacturing an apertured mask for a color CRT picture tube which achieved the aforementioned attributes through annealing first in a reducing atmosphere a nickel-iron alloy material particularly Invar according to a time temperature relationship between 1652 degrees F. and 2192 degrees F., then warm forming the apertured mask to a specific contour, and subsequently stress relief annealing the contoured mask material in an controlled oxidizing atmosphere to blacken the material at about 1450 degrees F. where the low coercive force of the material can be also restored to a low level following the deformation of forming.

BRIEF DESCRIPTION OF THE DRAWINGS

These features and advantages of the present invention as well as others will be more fully understood when the following description is read in light of the accompanying drawing which is a flow chart diagram of a process for producing an apertured mask according to the present invention.

DESCRIPTION OF THE PREFERED EMBODIMENT

In the present invention a shadow mask material comprises a nickel-iron alloy such as Invar having a composition in weight percent of carbon from 0.050 to 0.120; manganese from 0.4 to 0.7; phosphorus of 0.03 maximum; sulfur of 0.03 maximum; silicon from 0.10 to 0.30; and nickel from 35.0 to 42.0; the remainder being principally iron. This mask material has different mechanical properties than the currently employed 1008 grade aluminum killed or rimmed carbon steel. In particular, the yield strength of the nickel-iron alloy is higher and Young's modulus is lower than the carbon steel. As a result, the spring back ratio is larger for the nickel-iron alloy than for the carbon steel. Accordingly when forming the apertured mask, problems are encountered with spring back at the corners of the formed mask. It is also desirable to have an apertured mask with a blackened surface to provide a high thermal emissivity to dissipate heat generated when the material is bombarded by electron is the picture or display tube. At the same time, the apertured mask must exhibit a D.C. coercive force of lower than 1.0 Oersted as measured from 10 kilogauss, to render the entire picture tube insensitive to deviations of flux in the earth's magnetic field as well as to stray magnetic fields generated near the working environment of the picture tube. The low coercive force enables effective demagnetization by degaussing coils built into the CRT. In accordance with the present invention the flow chart identifies an initial step of selecting an mask blank having apertures therein. A strip of nickel-iron alloy is selected having a desired thickness and width from which aperture blanks are taken in a manner per se well known in the art. Before blanks are taken from the strip, the strip is processed in a manner well known in the art to form apertured openings by, for example a photo resist process. Examples of such a photo resist process to provide patterns of apertures in metal stock material can be found in U.S. Pat. Nos. 4,427,396 and 4,210,843.

The flat mask blanks are then heat treated by first annealing the flat mask blanks to a temperature of at least 1652 degrees F. and preferably not higher than 2192 degrees F. for a period of at least 5 minutes at temperature in a reducing gas or gas mixture to impart desired tensile properties to the nickel-iron alloy whereby the yield strength of the material is reduced, and coincidentally to provide a D.C. coercive force of less than 1.0 Oersted as measured from 10 kilogauss as a consequence of proper selection of the annealing atmosphere, time, and temperature.

The reducing atmosphere during the annealing process of the flat apertured masks can be hydrogen, nitrogen or combinations of these gases, having a dew point sufficiently low to prevent oxidation of the iron or nickel contents of the Invar alloy. The temperature which the annealing process is carried our can be as low as 1652 degrees F. and up to 2192 degrees F. The soaking time during annealing may be as long as 4 hours where desired, however, annealing times such that the mask material is within the above temperature range for as short as 5 minutes is sufficient. However, the longer time at temperature and the higher the temperature the better the D.C. coercive force property attained.

The annealed mask blanks are then formed to a desired curvature having the same form as the glass picture tube screen containing the phosphor dots. The forming operation is preferably carried out at a temperature of about 200 degrees F. during which the blanks are elastically deformed to the desired curvature. This step of the present invention provides a process which eliminates the spring back problem heretofor associated with the warm forming operation as well as providing an aperture mask having a low thermal expansion coefficient as well known in the art.

According to the present invention shown as in the flow diagram the formed masks are given a second annealing treatment in a manner to combine the functions of stress relief annealing and blackening wherein the masks are heat treated by annealing at a temperature of at least 1450 degrees F. in an atmosphere having a controlled oxidizing potential for a period of time sufficient to form an adhered black oxide coating which is an oxide of the nickel-iron alloy material. The total time for the annealing process can be as short as 90 seconds but longer times can be employed as desired. Some alteration of the time-oxidizing potential relationships will be required for longer anneal times to prevent excessive oxidation. Normally this anneal can be completed in any inert or reducing gas such as nitrogen, argon, or hydrogen, mixture to which a controlled amount of moisture is added. The inert gas atmosphere, 100% nitrogen, to which moisture is added to achive a dew point of +90 degrees F., provides an adequate oxidizing potential at 1450 degrees F. to achieve the correct blackening oxidation in 90 seconds. In this step of the present invention, the process provides the aperture mask having a blackened surface of high thermal emissivity, and at the same time relieves the strains imparted by the forming operation which, is required to restore the coercive force of the mask to less than 1.0 Oersted.

The oxidizing atmosphere employed in the stress relief annealing of the contoured aperture masks to achieve blackening and restoration of the coercive force to low values can be nitrogen, argon, or combinations of nitrogen and hydrogen to which a controlled moisture content is added. To achieve the object of the current invention the soaking time during annealing of the contoured mask can be controlled to achieve both stress relief and blackening. This annealing time can be as long or short as desired as long as the tight black oxide is formed on the surface of the contoured aperture mask. The black tightly adhering oxide desired on the metal surface is preferably less than 1500 angstroms thick. Development of thicker oxides will cause spalling and loss of adhesion. The black oxide coating on the metal is tightly adhered and provides a thermal emissivity that is higher than a bright annealed surface. Also, the coercive forces of metal samples annealed in the manner of the present invention still have values lower than 1.0 Oersted.

In the following table there is set forth magnetic coercive forces of samples annealed under various conditions for the first annealing step.

TABLE 1

| Sample | Annealing Atmosphere | Annealing Soak Temp. | Dew Pt. | Annealing Soak Time | D.C. Coercive Force from 10 kG |
|---|---|---|---|---|---|
| A1 | 100% $H_2$ | 2150 F. | −60 F. | 4 hours | 0.0594 |
| A2 | 100% $H_2$ | 1850 F. | −60 F. | 1 hour | 0.0988 |
| A3 | 100% $H_2$ | 1650 F. | −60 F. | 1 hour | 0.298 |
| A4 | 80% $N_2$-20% $H_2$ | 1850 F. | −60 F. | 1 hour | 0.149 |
| A5 | 80% $N_2$-20% $H_2$ | 1650 F. | −60 F. | 1 hour | 0.343 |
| A6 | 100% $N_2$ | 1475 F. | +90 F. | 1 hour | 5.35 |

TABLE 1-continued

| Sample | Annealing Atmosphere | Annealing Soak Temp. | Dew Pt. | Annealing Soak Time | D.C. Coercive Force from 10 kG |
|---|---|---|---|---|---|
| A7 | 100% $N_2$ | 1650 F. | −30 F. | 5 min. | 0.4192 |

Further, the second annealing superimposed on the above sample A1 produced a coercive force of 0.0657 after an anneal of 90 seconds in a 100% nitrogen atmosphere with a dew point of +90 degrees F. Sample A5 was also processed through the second annealed in the 100% nitrogen +90 degree dew point for 90 seconds. After this second annealing sample A6 exhibited a coercive force of 0.371. Both examples showing that the coercive force is not deleteriously affected by the oxidizing anneal which produces the blackened surface.

Preferably the reducing atmosphere maintained during the first annealing process may comprise 100% hydrogen or nitrogen or combinations of the two gasses. The annealing dew points should be maintained at a low value to prevent internal oxidation of the constituents of the nickel-iron alloy. In the case of sample A6 the oxidizing potential was excessive in the first annealing step producing an unacceptable value for the coercive force. It has been discovered, according to the present invention that both low initial tensile strengths as well as low coercive forces are obtained by the same annealing treatment of the mask blanks. It has been found that the result in the coercive forces are well below, as shown in Table I, the desirable 1.0 Oersted maximum obtained by low carbon steel in this application. Moreover, it has been found that by proper selection of the second annealing conditions the dual result desired is achieved having a restored low coercive force and a blackened high thermal emissivity surface are achieved by the present invention.

While the present invention has been described in connection with the preferred embodiments shown in the drawing, it is understood that other similar embodiments may be used or modifications and additions may be made to the described embodiment for performing the same functions of the present invention without deviating therefrom. Therefore, the present invention should not be limited to any single embodiment, but rather construed in breadth and scope in accordance with the recitation of the appended claims.

What is claimed is:

1. A method for processing an apertured mask said method including the steps of:

selecting a nickel-iron alloy mask blank having apertures therein;

a first annealing of the mask in a manner to provide a D.C. coercive force of less than 1.0 Oersted as measured from 10 kG and coincidentally to provide a material having low springback characteristics;

warm forming the mask blank to a desired curved profile for the aperture mask; and second annealing the formed aperture mask at a temperature of at least 1450 F. degrees F. in a controlled oxidizing atmosphere for a period of time sufficient to produce a tightly adhered black oxide coating on the surface of the metal comprising the aperture mask, and to remove strain from the forming operation.

2. The method according to claim 1 wherein said first annealing is carried out at a temperaure within the range of 1652 to 2192 degrees F.

3. The method according to claim 1 wherein said first annealing is carried out for a period of greater than 5 minutes and up to four hours.

4. The method according to claim 1 wherein said first annealing is carried out in a reducing atmosphere with a dew point sufficiently low to prevent internal oxidation of the nickel-iron alloy.

5. The method according to claim 1 wherein said warm forming the mask blank is carried out at a temperaure of at least 200 degrees F.

6. The method according to claim 1 wherein said first annealing is carried out in a reducing atmosphere which comprises hydrogen, nitrogen, or hydrogen-nitrogen mixtures.

7. The method according to claim 1 wherein said oxidizing atmosphere for the second annealing comprises nitrogen, argon or hydrogen with controlled amounts of moisture as an oxidizing agent.

8. The method according to claim 1 wherein said oxidizing atmosphere for the second annealing comprises 100% nitrogen with a dew point of +90 degrees F., and where the time of the annealing is 90 seconds.

9. The article of manufacture produced according to the method of claim 1.

* * * * *